US006845786B1

(12) United States Patent
Ophardt et al.

(10) Patent No.: US 6,845,786 B1
(45) Date of Patent: Jan. 25, 2005

(54) SPIGOT VALVE

(76) Inventors: Heiner Ophardt, 3931 Vineland Crescent, Vineland, Ontario (CA), L0R 2C0; Andrew Edward Jones, 34 Battersea Ave., St. Catharines, Ontario (CA), L2P 1L7

( * ) Notice: Subject to any disclaimer, the term of this patent is extended or adjusted under 35 U.S.C. 154(b) by 0 days.

(21) Appl. No.: 10/819,200

(22) Filed: Apr. 7, 2004

(51) Int. Cl.[7] ..... E03B 1/00

(52) U.S. Cl. ..... 137/614.11; 137/628; 251/263

(58) Field of Search ..... 137/614.1, 628, 137/329.4; 251/263

(56) References Cited

U.S. PATENT DOCUMENTS

| | | | | | |
|---|---|---|---|---|---|
| 193,231 | A | * | 7/1877 | Distelrath | 137/614.11 |
| 796,576 | A | * | 8/1905 | Graham | 137/605 |
| 910,213 | A | * | 1/1909 | Mikesch | 137/630.22 |
| 968,037 | A | * | 8/1910 | Erskine | 137/636.4 |
| 1,633,642 | A | * | 6/1927 | Kramer | 137/322 |
| 3,612,354 | A | * | 10/1971 | Sitton et al. | 222/3 |
| 5,423,350 | A | * | 6/1995 | Zinck | 137/625.48 |

* cited by examiner

*Primary Examiner*—A. Michael Chambers
(74) *Attorney, Agent, or Firm*—Riches, McKenzie & Herbert LLP

(57) ABSTRACT

A spigot valve, which on opening and closing of the spigot valve, selectively moves a plunger member to selectively open and close a closure valve at the outlet of a container to which a spigot valve is connected.

13 Claims, 8 Drawing Sheets

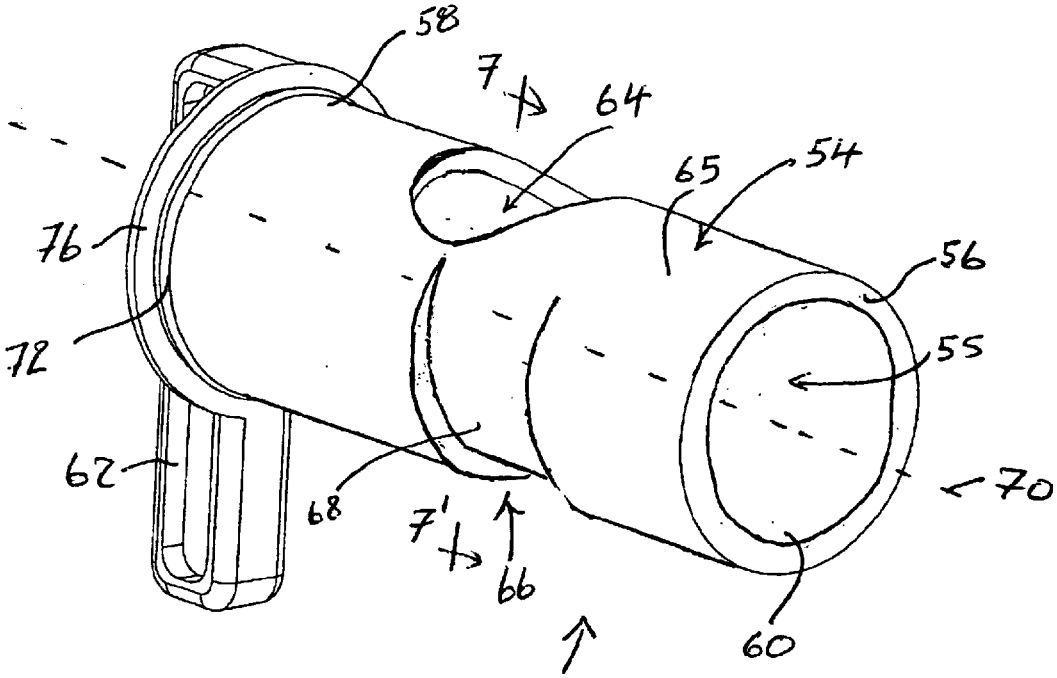
FIG 6
FIG 7
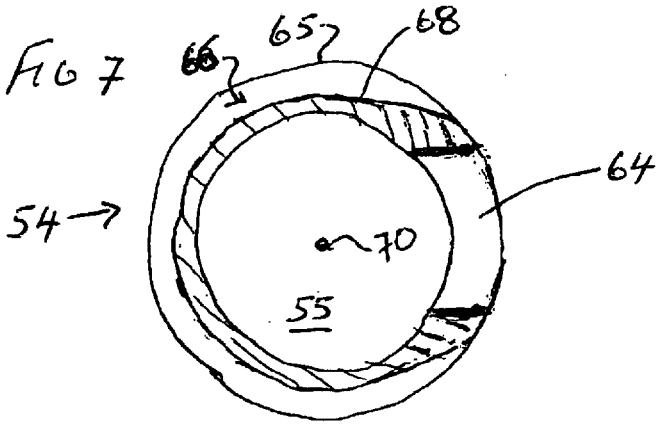

SPIGOT VALVE

SCOPE OF THE INVENTION

This invention relates to a spigot valve and, more particularly, to a spigot valve with a coupled plunger for activating a one-way inlet valve to the spigot valve in tandem with the spigot valve.

BACKGROUND OF THE INVENTION

Dispensers are known for fluids such as sugar based concentrated flavouring for beverages which are provided in a container having a one-way outlet valve which is biased to a closed position and may be opened by biasing the one-way valve inwardly into the container.

Previously known devices fail to provide a simplified spigot valve for such containers.

SUMMARY OF THE INVENTION

To at least partially overcome these disadvantages of previously known devices, the present invention provides a spigot valve including a plunger which plunger is operated in tandem with the spigot valve for extension of the plunger from the spigot valve when the spigot valve is moved to an open position.

An object of the present invention is to provide a simplified spigot valve for dispensing fluids from a container closed with a one-way closure valve.

Another object is to provide a simplified spigot valve in which all of the components can readily be disassembled for cleaning as is preferred for use in the food industry.

Another object is to provide a spigot valve which, on opening and closing of the spigot valve, selectively moves a plunger member to selectively open and close a closure valve at the outlet of a container to which a spigot valve is connected.

In one aspect, the present invention provides a spigot valve comprising a casing member, a valve member and a plunger member, the casing member comprising a hollow inlet tube and a hollow outlet tube extending transversely to the inlet tube, the inlet tube having a side wall about a passageway therethrough from an open inlet end to an open exit end, the outlet tube having a side wall about a passageway therethrough from an open handle end to an open outlet end, the inlet end of the inlet tube adapted for coupling to a source of fluid to be dispensed, the exit end of the inlet tube sealably joined to the side wall of the outlet tube intermediate the handle end and the outlet end with the inlet tube passageway in communication with the outlet tube passageway via an entranceway through the side wall of the outlet tube, the valve member coaxially journalled in the outlet tube passageway for pivoting about a valve axis extending longitudinally of the outlet tube, the valve member having a handle extending out of the handle end of the outlet tube for manipulation to pivot the valve member about the valve axis relative the outlet tube between an open position and a closed position, the valve member having an outer surface which engages an inner surface of the passageway of the outlet tube sealably closing the entranceway against fluid flow therethrough when the valve member is in the closed position and permitting fluid flow from the inlet tube passageway through the entranceway into the outlet tube passageway and out the outlet end when the valve member is in the open position, the plunger member slidably longitudinally disposed within the inlet tube passageway with a first end of the plunger proximate the inlet end and a second end of the plunger member extending through the entranceway into contact with a plunger camming surface carried on the valve member, the plunger camming surface limiting the extent to which the plunger member can slide longitudinally in the inlet tube passageway through the entranceway, the plunger camming surface disposed a radial distance from the valve axis which varies circumferentially such that when the valve member is in the open position the plunger member can slide longitudinally through the entranceway a first distance and when the valve member is in the closed position the plunger member can slide longitudinally through the entranceway a second distance greater than the first distance.

Preferably, the spigot valve is used in combination with a container containing fluid in its interior to be dispensed through a container outlet, a closure valve disposed across the container outlet for movement between an open position in which the closure valve permits fluid flow from the container out through the container outlet and a closed position in which the closure valve prevents fluid flow from the container out through the container outlet, the closure valve biased to assume the closed position, the closure valve moving away from the container outlet into the interior during movement of the closure valve from the closed position to the open position and moving toward the container outlet out of the interior during movement of the closure valve from the open position to the closed position, the container outlet coupled to the inlet end of the inlet tube with the first end of the plunger member extending into the container outlet to engage the closure valve, the plunger member having a length between its first end and second end that when the valve member is in the open position with the second end of the plunger member engaged on the plunger camming surface, the first end of the plunger member displaces the closure valve away from the container outlet and into the interior placing the closure valve in the open position and when the valve member is in the closed position sufficient distance exists between the plunger camming surface and closure valve that the plunger member does not prevent the closure valve from assuming the closed position.

BRIEF DESCRIPTION OF THE DRAWINGS

Further aspects and advantages of the present invention will occur from the following description taken together with the accompanying drawings in which:

FIG. 6 is a perspective view of the valve member of the spigot valve of FIG. 1;

FIG. 7 is a cross-sectional view along section line 7–7' in FIG. 6;

DETAILED DESCRIPTION OF THE DRAWINGS

Figure 1:
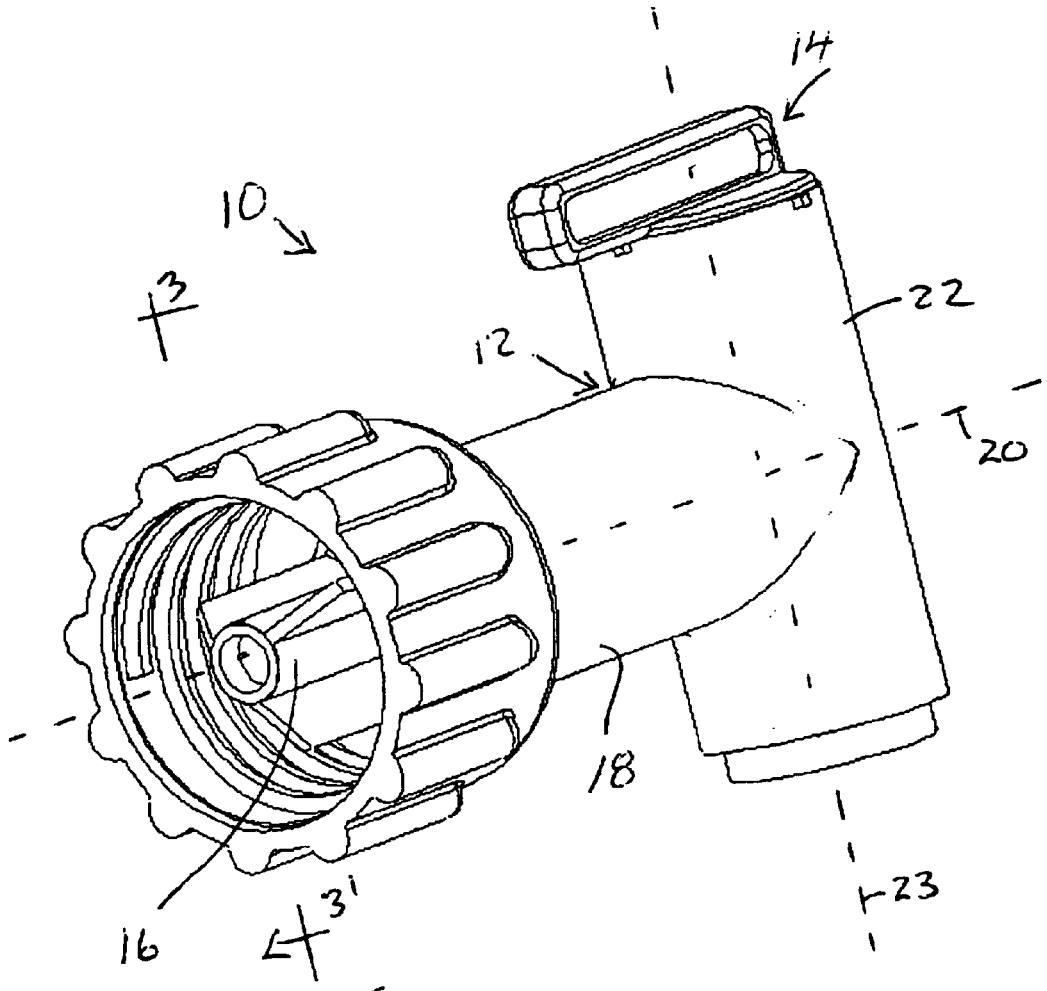
FIG. 1 is a pictorial view of a spigot valve in accordance with a preferred embodiment of the present invention.
Figure 2:
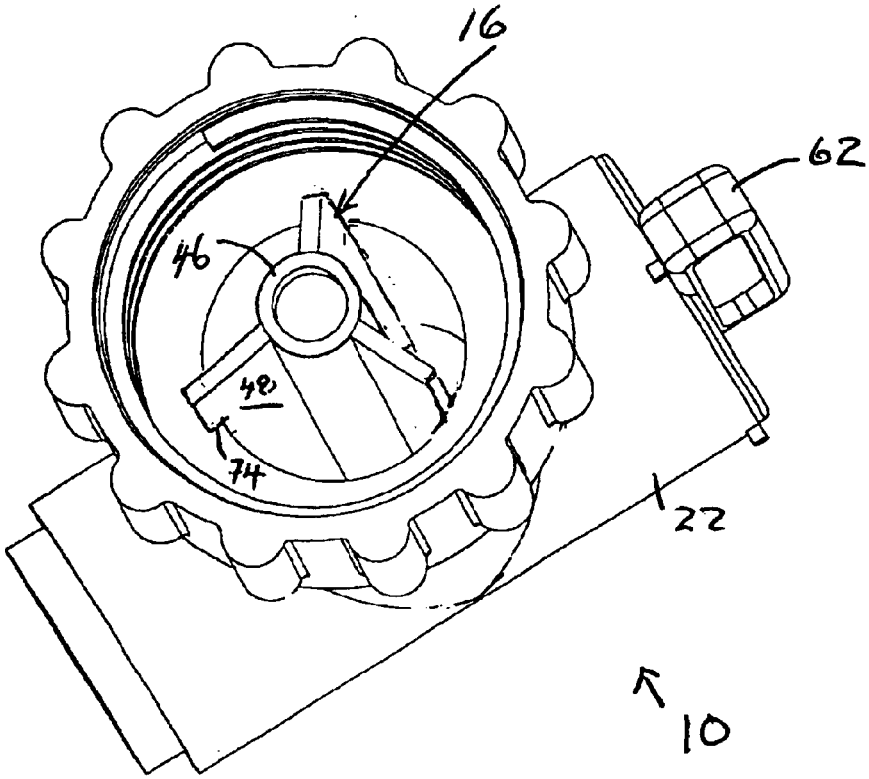
FIG. 2 is a end perspective view of the spigot valve of FIG. 1.

Reference is made to FIGS. 1 and 2 which show pictorial views of a spigot valve 10 in accordance with the first preferred embodiment of the present invention. The spigot valve includes a casing member 12, a spigot or valve member 14 and a plunger member 16.

The casing member 12 comprises a hollow inlet tube 18 about an axis 20 and a hollow outlet tube 22 extending transversely to the inlet tube 18 about an axis 23.

Figure 3:
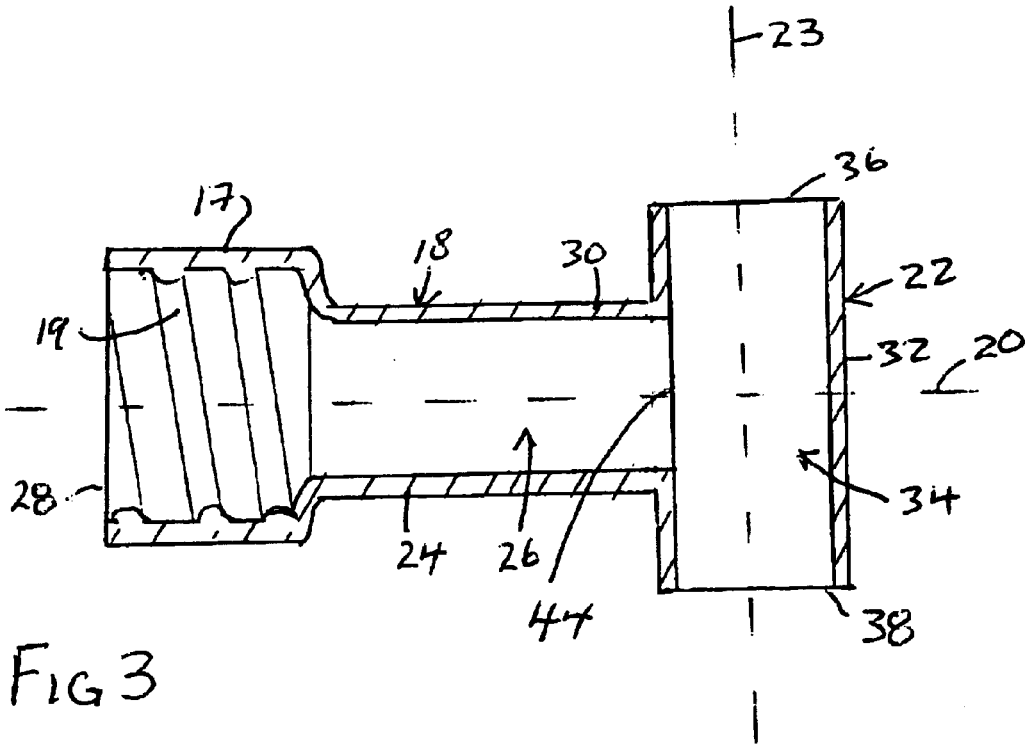
FIG. 3 is a cross-sectional side view of the casing member of FIG. 1 along section line 3–3'.

As best seen in FIG. 3, the inlet tube 18 has a side wall 24 about a passageway 26 therethrough from an open inlet end 28 to an open exit end 30.

The outlet tube 22 has a side wall 32 about a passageway 34 therethrough from an open handle end 36 to an open outlet end 38. The inlet end 28 of the inlet tube 18 is provided as a collar 17 with internal threads 19 to adapt the inlet end 28 to be coupled as is merely shown in FIGS. 8 and 9 to a threaded male outlet 40 of a container 42 to contain fluid to be dispensed which container 42.

The exit end 30 of the inlet tube 18 is sealably joined to the side wall 32 of the outlet tube 22 intermediate the handle end 36 and the outlet end 38 with the inlet tube passageway 26 in communication with the outlet tube passageway 34 via an entranceway 44 through the side wall 32 of the outlet tube 22.

Figure 4:
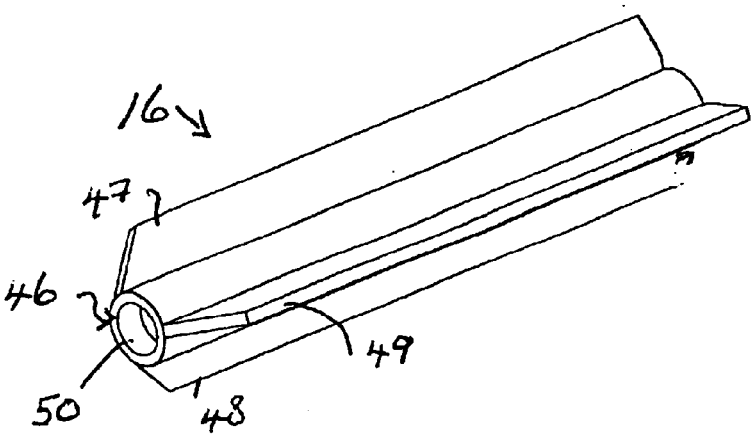
FIG. 4 is a perspective view of a plunger member of the spigot valve of FIG. 1.
Figure 5:
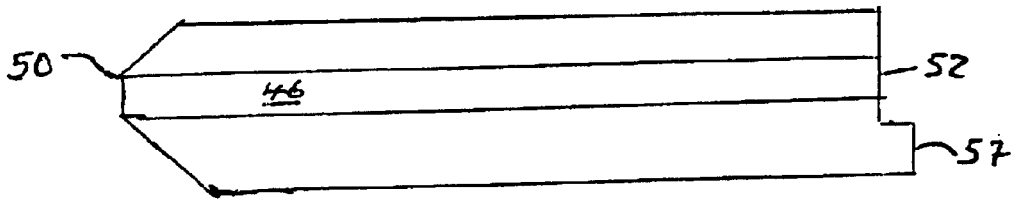
FIG. 5 is a side view of the plunger member of FIG. 4.

As best seen in FIG. 4, the plunger member 16 comprises an elongate member having a central tube 46 from which three vanes 47, 48 and 49 extend radially outwardly axially along the length of the tube 46 spaced circumferentially about the tube 46. As best seen in side view in FIG. 5, at a first end 50 of the plunger member, the three vanes taper away from the tube 46. At the second end 52 of the plunger member, the bottom-most vane 48 has a cam arm 57 which extends farther axially than either of the uppermost vanes 47 and 49.

The valve member 14 is best seen in FIGS. 6 and 7 as including a cylindrical tube 54 about axis 70 having a side wall 56 and a passageway 55 therein which passageway 55 and tube 54 are closed at an upper handle end 58 and open at a lower dispensing end 60. A handle 62 extends radially at the handle end 58 of the valve member 14. A port 64 is provided through the side wall 56 of the cylindrical tube 54 of the valve member 14.

The cylindrical tube 54 of the valve member 14 has an outer surface 65 which is cylindrical, however, a plunger camming slot 66 is provided to extend radially inwardly into the circumferential outer surface 65 as best seen in FIGS. 6 and 7. FIG. 7 shows that a plunger camming surface 68 extends entirely circumferentially around the tube 54 in part within the slot 66 and otherwise as an axially aligned portion of the cylindrical outer surface 65 bridging between the ends of the slot 66. The plunger camming surface 68 is disposed at a radial distance from a valve axis 70 about which the cylindrical tube 54 and its outer surface 65 is disposed such that the plunger camming surface 68, best shown in cross-section in FIG. 7, varies in distance from the valve axis 70 circumferentially about the valve member 14.

Figure 8:
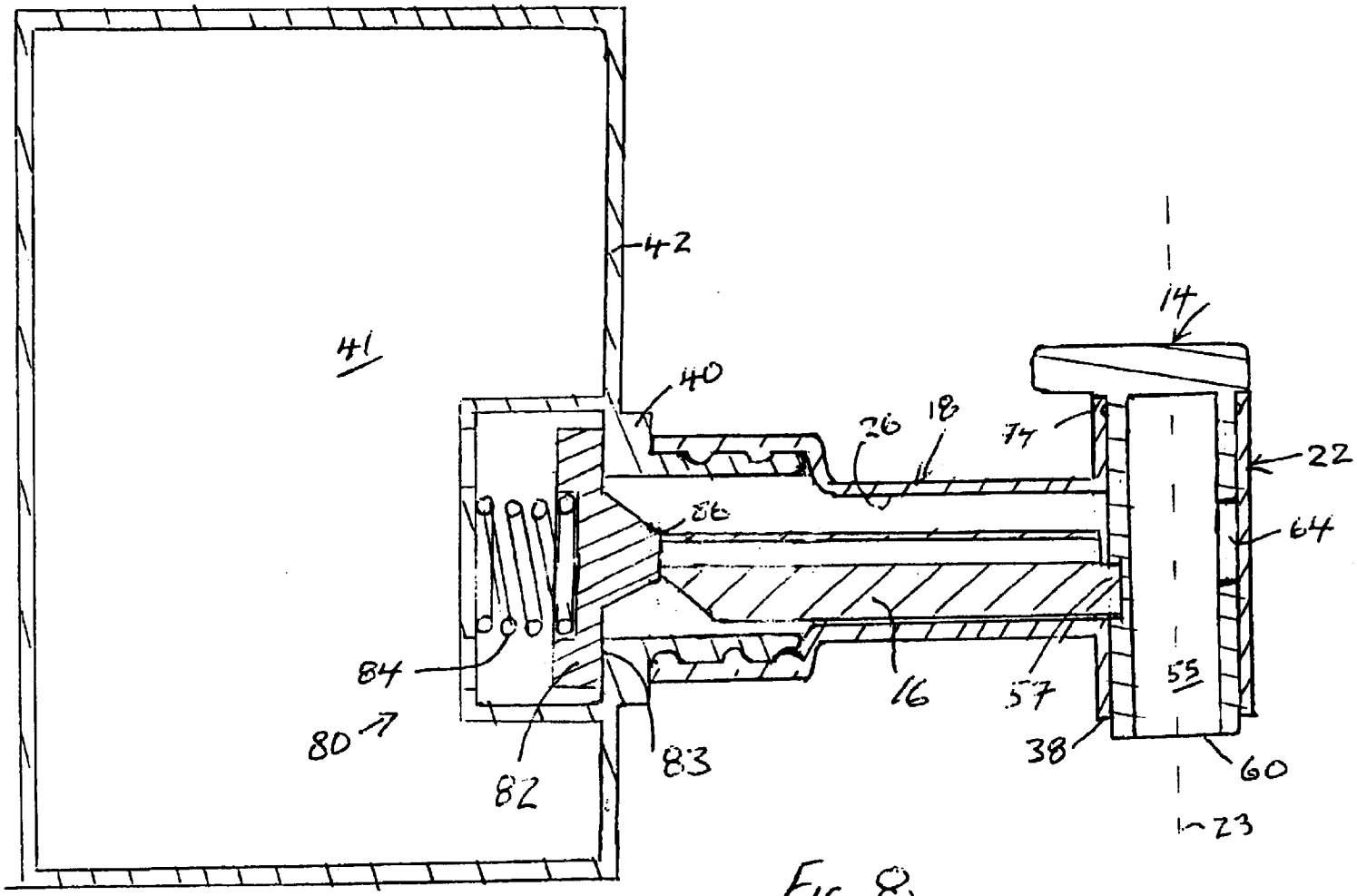
FIG. 8 is a cross-sectional side view through the spigot valve of FIG. 1 with the valve member in an open position and with the spigot valve coupled to an outlet of a container.
Figure 9:
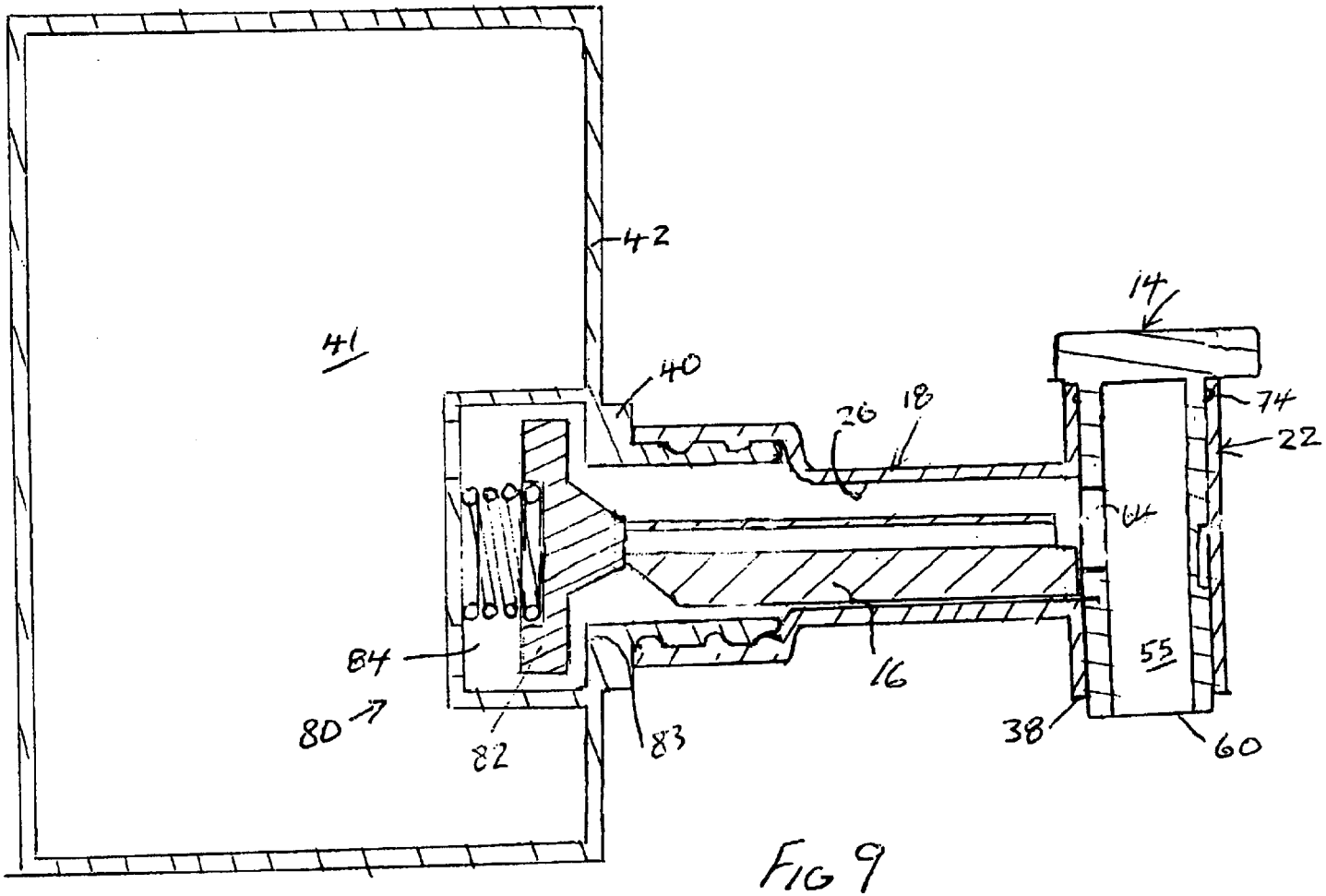
FIG. 9 is a view similar to that in FIG. 8, however, with the valve member in a closed position.

FIGS. 8 and 9 show side views of the spigot valve 10 assembled and coupled to the outlet 40 of container 42.

The plunger member 16 is coaxially disposed within the passageway 26 of the inlet tube 18. As best seen in FIG. 2, the side wall 24 of the inlet tube 24 is provided with a slot 74 adapted to receive the vane 48 therein and maintain the plunger member 16 in a desired angular position relative to the passageway 26.

The valve member 14 is coaxially slidable into and out of the outlet tube 22 via the open handle end 36 for assembly and disassembly with axes 70 and 23 coaxial. During use of the assembled valve 10, the valve member 14 is not to move axially along the valve axis 70 relative to the outlet tube 22. The valve member 14 has a stop flange 76 which extends radially outwardly from the outer surface 65 of the cylindrical tube 54 to engage an end surface of the outlet tube 22 about the handle end 36 and locate the valve member 12 in a fully inserted position.

In addition, the cylindrical outer surface 64 of the cylindrical tube 54 has an annular boss 72 extending marginally outwardly therefrom to be adapted to be received as in a snap-fit relation in a corresponding annular groove 74 provided in the inside surface of the outlet tube 22. In the assembled spigot valve 10, the cam arm 57 of the bottom vane 48 at the second end 52 of the plunger member 16 engages on the plunger camming surface 68 which extends circumferentially about the valve member 14. The plunger camming surface 68 is that surface defined within the plunger camming slot 66 where the slot 66 is provided to extend radially into the outer surface 64 together with portions of the cylindrical outer surface 65 at the same axial location as the plunger camming slot 66 circumferentially between ends of the camming slot 66.

FIG. 8 illustrates a position in which the valve member 14 has been rotated to an open position in which the port 64 is in communication with the entranceway 44 permitting fluid flow from the passageway 26 of the inlet tube 18 via the entranceway 44 and the port 64 into the passageway 55 inside the valve member 14 and, hence, out of the dispensing end 60 of the valve member 14. Of course, it is to be appreciated that fluid flow through the passageway 55 of the tube 54 of the valve member 14 is also flow through the passageway 34 of the outlet tube 22.

Reference is made to FIG. 9 which illustrates a position in which the valve member 14 has been rotated 180° from the open position shown in FIG. 8 to a closed position in which the cylindrical outer surface 65 of the tube 54 of the valve member 14 closes the entranceway 44 against fluid flow therethrough. A substantially fluid impermeable seal may be formed by the cylindrical outer surface 65 of the tube 54 of the valve member 14 engaging with the cylindrical inner surfaces of the side wall 32 of the outlet tube 22 about the entirety of the perimeter of the entranceway 44.

FIGS. 8 and 9 schematically illustrate the spigot valve 10 in accordance with the present invention coupled to a male container outlet 40 of a container 42 carrying liquid 41 desired to be dispensed. The outlet container 40 carries a one-way closure valve generally indicated 80 including a closure valve member 82 biased to a closed position into perimeter surfaces 83 of an entry to the container outlet 40 via a spring 84. The closure valve 80 is movable between the closed position of FIG. 9 which prevents fluid flow from the container 42 out through the container outlet 40 and an open position of FIG. 8 in which the closure valve 80 permits fluid flow from the container 42 out of the container outlet 40. The closure valve 80 is biased to assume the closed position. For fluid to be dispensed from the container 42, the closure valve member 82 must be urged inwardly into the container 42 against the bias of the spring 84 to an open position as seen in FIG. 8. The closure valve member 82 has, at it axial centre, an activator surface 86 coaxially disposed relative the outlet 40, the inlet tube 18 and the tube 46 of the plunger member 16 such that axial movement of the plunger member 16 can engage the activator surface 86 with the end of the tube 46 and move the closure valve member 82 against the bias of the spring 84 to open the closure valve 80.

Referring to FIG. 9, with the spigot valve 10 in a closed position, the closure valve 80 is also in a closed position. This arises in that the length of the plunger member 16 is selected such that the distance between (a) the activator surface 86 on the closure valve member 82 with the closure valve member 82 in the closed position, and (b) the plunger camming surface 68 is less than the length of the plunger member from the end of the tube 46 to the end of the cam arm 57. In contrast, referring to FIG. 8 which shows the valve member 14 in the open position, the plunger member 16 has been moved to the left by reason of the end of the cam arm 57 of bottom vane 48 at the second, right-hand end 52 of the plunger member 16 becoming engaged on a portion of the plunger camming surface 68 which is spaced a greater distance from the valve axis 70 in FIG. 8 than the portion of the plunger camming surface 68 which the plunger member 16 engages in the plunger camming slot 66 in FIG. 9. As seen in FIG. 8, the plunger member 16 is in engagement with the activator surface 86 of the closure valve member 82 and the closure valve member 80 has been moved to an open position permitting fluid to flow from the container 42 through the spigot valve 10 and out of the dispensing end 60.

In moving the valve member 14 between the open and the closed position, the plunger member 16 will have a maximum stroke for movement towards the activator surface 86 as indicated by the spacing of the distance of the plunger camming surface 68 from the cylindrical outer surface 65 between a minimum as illustrated in the closed position in FIG. 9 and a maximum as illustrated in the open position of FIG. 8.

Each of the casing member 12, valve member 14 and plunger member 16 is preferably an integral plastic element as formed by, preferably, injection moulding. The spigot valve 10 may readily be disassembled by removal of the valve member 14 and the plunger member 16 from the casing member 12 as is preferred for use in food applications for ease of cleaning and ensuring sanitation.

As best seen in FIG. 8, the entranceway 44 extends axially towards the outlet end 38 of the outlet tube 22 to a greater extent than the port 64 such that the cam arm 57 of the vane 48 of the plunger member 16 extends through the entranceway 44 into engagement with the plunger camming surface 68 on the valve member 14 axially below the port 64.

With the preferred embodiment of the present invention, undesired dripping from the container 42 will be prevented in the closed positions both by reason of both the spigot valve 10 and the closure valve 80 being in closed positions.

Figure 10:
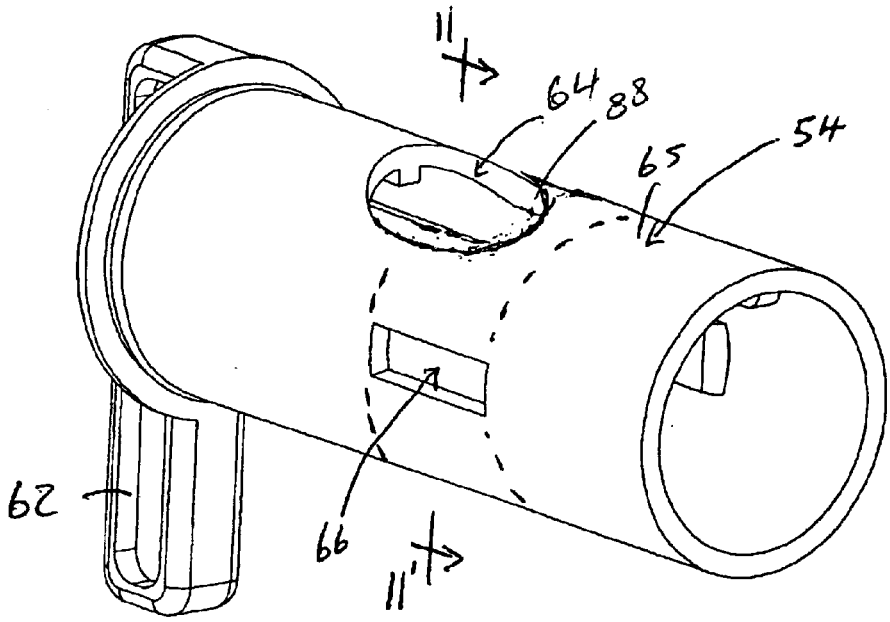
FIG. 10 is a perspective view similar to FIG. 6 but of an alternate embodiment of the spigot valve.
Figure 11:
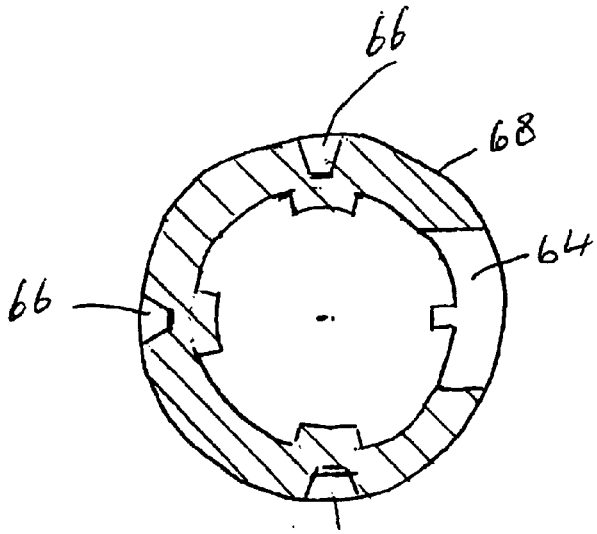
FIG. 11 is a cross-sectional view along line 11–11' in FIG. 10.

Reference is made to FIGS. 10 and 11 which illustrate an alternate embodiment of a valve member 14 for substitution for the valve member 14 in FIGS. 1 to 9. In FIG. 10, the valve member has three camming slots 66, each of which is but an axially extending slot of a circumferential extent and an axial extent sufficient to receive the end of the cam arm 57 of the vane 48 therein. The camming slots 66 are disposed at 90°, 180° and 270° from the centre of the port 64. The camming surface 68 is the surfaces between the broken lines in FIG. 10 and comprises the camming slots 66 and the cylindrical surface 65 of the tube 54 between the camming slots. Only one or more of the camming slots 66 is necessary. In FIGS. 10 and 11, internal axially extending reinforcing ribs underlie the slots 66.

The preferred embodiment of the FIGS. 1 to 9 show a plunger member 16 which must be in a desired angular registry in the inlet tube 24. Other angular registry systems may be adopted to ensure the plunger member 16 is in a desired angular registry with the inlet tube 24, such as with a slot for each vane with the vanes not provided at equal spacing or with one vane and its slot to have a greater width.

Other configurations of plunger members 16 can be used which avoids the need for such angular registry such as having the second end surface of the plunger member 16 to engage the camming surface 68 be a circular tube such as tube 46.

Preferably, in accordance with the preferred embodiment of the present invention, when the valve member 14 is rotated angularly to a small extent, either clockwise or counterclockwise, from the fully open position shown in FIG. 8, the plunger camming surface 68 will quickly decrease in its distance from the valve axis 70 such that the closure valve 80 will become closed with only small rotation of the valve member 14. Preferably, the closure valve 84 is closed when the valve member is rotated only a small amount from the fully open position, preferably, less than 10° or less than 15° or less than 45°. Provided the valve member 14 is not within these angular positions in which the closure valve is open, then the spigot valve 10 can be threaded onto the male outlet 40 of the container 42 without fluid undesirably flowing out of the container 42 on the spigot valve 10 being attached.

In accordance with the preferred embodiment in pivoting the valve member 14 from an open position towards a closed position, the closure valve 80 closes after but a relatively small angular rotation of, say, 10° or 15° or 45°, but the entranceway 44 and the port 64 remains at least partially in communication with each other after the closure valve 80 has been closed and until the valve member 14 is rotated, for example, 60° or 90° from the open position. This has the advantage that fluid in the spigot valve 10 may have an opportunity while the closure valve 80 is closed and the spigot valve 10 is open to drain out through the dispensing end 60 of the valve member 14 which can assist in preventing undesired dripping by voiding the spigot valve 10 of fluid which may potentially drip out. A preferred manner of use of the spigot valve 10 in accordance with the present invention is in closing the spigot valve 10 to move it from the open position to a drain position intermediate the open position and the closed position with the drain position being selected to be a position in which the closure valve 80 is closed but communication remains between the entranceway 44 and the port 64 to permit fluid within the spigot valve 10 to drain under gravity out the outlet end 38 of the outlet tube 22 and the dispensing end 60 of the valve tube 54 and be replaced by air which will enter the spigot valve 10 up through the outlet end 38 and the dispensing end 60. After having the spigot valve in a drain position to drain out fluid, the spigot valve 10 may then be closed. The port 64 may be sized and located to facilitate draining in a drain position as with the port 64 in an open position.

In the embodiment of FIGS. 1 to 9, the preferred open and closed positions are 180° apart, however, once the valve member 14 has been rotated 90°, the spigot valve 10 is effectively in a closed position.

The plunger camming surface 68 as shown in FIGS. 6 and 7 provides for a continuous transition for gentle camming movement of the plunger member 16 with rotation or pivoting of the valve member 14. This is not necessary, however, and the plunger camming surface 68 may change in a step manner as in FIGS. 10 and 11.

Many modifications and variations of the present invention will now occur to persons skilled in the art. For a definition of the invention, reference is made to the appended claims.

We claim:

1. A spigot valve comprising a casing member, a valve member and a plunger member, the casing member comprising a hollow inlet tube and a hollow outlet tube extending transversely to the inlet tube, the inlet tube having a side wall about a passageway therethrough from an open inlet end to an open exit end, the outlet tube having a side wall about a passageway therethrough from an open handle end to an open outlet end, the inlet end of the inlet tube adapted for coupling to a source of fluid to be dispensed, the exit end of the inlet tube sealably joined to the side wall of the outlet tube intermediate the handle end and the outlet end with the inlet tube passageway in communication with the outlet tube passageway via an entranceway through the side wall of the outlet tube, the valve member coaxially journalled in the outlet tube passageway for pivoting about a valve axis extending longitudinally of the outlet tube, the valve member having a handle extending out of the handle end of the outlet tube for manipulation to pivot the valve member about the valve axis relative the outlet tube between an open position and a closed position, the valve member having an outer surface which engages an inner surface of the passageway of the outlet tube sealably closing the entranceway against fluid flow therethrough when the valve member is in the closed position and permitting fluid flow from the inlet tube passageway through the entranceway into the outlet tube passageway and out the outlet end when the valve member is in the open position, the plunger member slidably longitudinally disposed within the inlet tube passageway with a first end of the plunger proximate the inlet end and a second end of the plunger member extending through the entranceway into contact with a plunger camming surface carried on the valve member, the plunger camming surface limiting the extent to which the plunger member can slide longitudinally in the inlet tube passageway through the entranceway, the plunger camming surface disposed a radial distance from the valve axis which varies circumferentially such that when the valve member is in the open position the plunger member can slide longitudinally through the entranceway a first distance and when the valve member is in the closed position the plunger member can slide longitudinally through the entranceway a second distance greater than the first distance.

2. A spigot valve as claimed in claim 1 in combination with a container containing fluid in its interior to be dispensed through a container outlet, a closure valve disposed across the container outlet for movement between an open position in which the closure valve permits fluid flow from the container out through the container outlet and a closed position in which the closure valve prevents fluid flow from the container out through the container outlet, the closure valve biased to assume the closed position, the closure valve moving away from the container outlet into the interior during movement of the closure valve from the closed position to the open position and moving toward the container outlet out of the interior during movement of the closure valve from the open position to the closed position, the container outlet coupled to the inlet end of the inlet tube with the first end of the plunger member extending into the container outlet to engage the closure valve, the plunger member having a length between its first end and second end that when the valve member is in the open position with the second end of the plunger member engaged on the plunger camming surface, the first end of the plunger member displaces the closure valve away from the container outlet and into the interior placing the closure valve in the open position and when the valve member is in the closed position sufficient distance exists between the plunger camming surface and closure valve that the plunger member does not prevent the closure valve from assuming the closed position.

3. A combination as claimed in claim 2 wherein the closure valve is disposed toward and accessible from the outlet.

4. A spigot valve as claimed in claim 1 in combination with a container containing fluid in its interior to be dispensed through an outlet conduit having an inlet and an outlet, a closure valve disposed across the outlet conduit inlet for movement between an open position in which the closure valve permits fluid flow from the container out through the outlet conduit and a closed position in which the closure valve prevent fluid flow from the container out through the outlet conduit, the closure valve biased to assume the closed position, the closure valve having an acuator surface disposed toward and accessible from the outlet end of the outlet conduit, the actuator surface of the closure valve moving away from the inlet of the outlet conduit into the interior during movement of the closure valve from the closed position to the open position and moving toward the inlet of the outlet conduit out of the interior during movement of the closure valve from the open position to the closed position, the outlet of the outlet conduit coupled to the inlet end of the inlet tube with the first end of the plunger member extending into the outlet conduit to engage the actuator surface, the plunger member having a length between its first end and second end that when the valve member is in the open position the with the second end of the plunger member engaged on the plunger camming surface, the first end of the plunger member displaces the actuator surface away from the inlet of the outlet conduit and into the interior placing the closure valve in the open position and when the valve member is in the closed position, sufficient distance exists between the plunger camming surface and actuator surface that the closure valve is in the closed position.

5. A spigot valve as claimed in claim 1 wherein the plunger camming surface extends at least partially circumferentially about the valve member and is a minimum radial distance from the valve axis when the valve member is in the open position and a maximum radial distance from the valve axis when the valve member is in a closed position.

6. A spigot valve as claimed in claim 1 wherein the plunger member is removable from the inlet end of the inlet tube, and the valve member is removable from the handle end of the outlet tube.

7. A spigot valve as claimed in claim 6 wherein each of the casing member, valve member and plunger member consists of a unitary piece of plastic.

8. A spigot valve as claimed in claim 1 wherein the inlet end of the inlet tube carries a threaded flange adapted for threaded coupling to a source of fluid to be dispensed.

9. A spigot valve as claimed in claim 1 wherein the outlet tube passageway is cylindrical, the valve member comprises a cylindrical tube having a side wall about a passageway therethrough from a closed handle end to an open dispensing end, the cylindrical tube of the valve member is coaxially disposed within the cylindrical passageway of the outlet tube, a port through the side wall of the cylindrical tube of the valve member which is in communication with the entranceway when the valve member is in the open position permitting fluid flow from the passageway of the inlet tube via the entranceway and port into the passageway of the cylindrical tube of the valve member and out the dispensing end of the cylindrical tube of the valve member, and when the valve member is in the closed position, the port is not in communication with the entranceway and the entranceway is closed by the side wall of the cylindrical tube of the valve member engaging the side wall of the outlet tube about the entranceway.

10. A spigot valve as claimed in claim 9 wherein the cylindrical tube of the valve member is longitudinally slidable into and out of the outlet tube passageway, the valve member moving between the open position and the closed position merely by rotation of the valve member about the valve axis without relative axial movement of the valve member relative the outlet tube.

11. A spigot valve as claimed in claim 9 wherein the cylindrical tube of the valve member is longitudinally slidable into and out of the outlet tube passageway via the handle end of the outlet tube for assembly and disassembly.

12. A spigot valve as claimed in claim 1 wherein the inlet tube passageway is cylindrical, the plunger member comprises an elongate member having a plurality of radially and axially extending locating vanes to coaxially locate the plunger member in the inlet tube passageway yet permit fluid flow longitudinally through the inlet tube passageway, one vane having a cam projection extending farther axially toward the valve member than a remainder of the plunger member for engagement with the plunger camming surface.

13. A spigot valve as claimed in claim 12 including a registry member to retain the plunger member in the inlet tube passageway against rotation relative the inlet tube.

* * * * *